US006277032B1

(12) United States Patent
Smith

(10) Patent No.: US 6,277,032 B1
(45) Date of Patent: Aug. 21, 2001

(54) MOVABLE WEIGHT GOLF CLUBS

(76) Inventor: Vigor C. Smith, P.O. Box 1609, Cashiers, NC (US) 28717

( * ) Notice: Subject to any disclaimer, the term of this patent is extended or adjusted under 35 U.S.C. 154(b) by 0 days.

(21) Appl. No.: 09/523,969

(22) Filed: Mar. 13, 2000

Related U.S. Application Data

(60) Provisional application No. 60/145,995, filed on Jul. 29, 1999.

(51) Int. Cl.[7] ..... A63B 53/06
(52) U.S. Cl. ..... 473/336; 473/345
(58) Field of Search ..... 473/334, 335, 473/336, 337, 338, 339, 341, 350, 345

(56) References Cited

U.S. PATENT DOCUMENTS 1,562,956 * 11/1925 Guerne .
2,460,445 * 2/1949 Bigler .
3,610,630 * 10/1971 Glover .
4,052,075 * 10/1977 Daly .
4,895,371 * 1/1990 Bushner .
5,924,938 * 7/1999 Hines .

* cited by examiner

*Primary Examiner*—Jeanette Chapman
*Assistant Examiner*—Stephen L. Blau
(74) *Attorney, Agent, or Firm*—Frank A. Lukasik

(57) ABSTRACT

The invention is directed to a golf club consisting of a golf club head having a base mounted within a cavity formed in the club head, a weight mounted on a slotted screw, supported by the base ends behind the striking face and movable in a direction from the heel of the club head to the toe of the club head.

2 Claims, 3 Drawing Sheets

MOVABLE WEIGHT GOLF CLUBS

RELATED APPLICATION

This application is a Continuation-In-Part of Provisional Application Serial No. 60/145,995, Filed Jul. 29, 1999.

BACKGROUND OF THE INVENTION

1. Field of the Invention

The invention relates to golf clubs and more particularly to the relationship between the weight at the toe, center or heel of the golf clubs.

2. Background of the Invention.

Golf clubs exist in a variety of sizes, styles, and materials. The essence of the club is to enable the golfer to propel the golf ball as far and as accurately as possible from the tee (starting shot) to the cup or hole in as few strokes as possible. Among the many variable factors the golfer has to consider are; wind direction, the condition of the terrain, and the distance to the pin or cup. Having no control of said factors, the golfer is left to rely upon personal skill, strength and strategy in order to play golf successfully.

The design of golf clubs has evolved to embrace new materials, manufacturing methods and physical characteristics all toward the end of improving the performance of the golfer. Golf club manufacturers are continuing to spend millions of dollars on developing new materials, shapes and weights of golf clubs to improve the golfer's score. Much of the design of golf clubs involves the design of the face of the club. In particular, the drivers are being developed which are made from stainless steel while the face of the club is made from titanium. The design of irons have been generally limited to the shape of the face of the club or perimeter weighting to provide a better, more even distribution of weight behind the ball. In addition, there are hundreds of different face designs to further control the flight of the golf ball. One such club is advertised to have a patented "invisible" curve (you can feel it, but barely see it) across their hitting surface that tames the stronger "gear" effect and draws off-center shots back to the middle of the fairway. Each of the prior art attempts have concentrated on the shape while the remaining structure remains conventional

DESCRIPTION OF THE PRIOR ART

Golf clubs currently available are designed with the club head and shaft joined together at such an angle that through the practice of what is regarded as a "standard" golf swing, the golfer can reasonably expect the head of the club to swing in a wide arc and contact positively with the ball. Variations in the golfer's grip upon the club produce inaccuracies in the flight of the ball because of the way the face of the club strikes the ball. Such factors are exaggerated by the design of existing clubs wherein the shaft and head are joined in an offset fashion. The offset tends to transmit the force of impact with the ball upwards through the shaft in a twisting or rotational direction which, if not overcome by the golfer's tight grip, turns the face of the club away from a line perpendicular to the intended course of travel of the ball. Depending upon the variation so produced, the ball is either "hooked" to the left of its intended path or "sliced" to the right. In either case, the result is often a penalty of distance or direction for the golfer.

One prior art effort to solve the problems discussed above is U.S. Pat. No. 3,064,980 to Steiner which discloses a variable golf club in which the weight of the head is adjustable or variable as desired. The golf club head is provided with a tapering opening in which weights are provided and the weights are retained in the opening by a screw member having a shoulder, or head and the head is positioned in a counter bore of a sole plate that is retained in a recess or cavity or indentation by screws. The head of the screw is provided with a screw driver slot by which the screw may be removed and replaced on the golf course.

U.S. Pat. No. 5,230,509 to Chavez discloses a putter having a "T" formation located at the rear portion of the club head with a weight that is designed to interlock and provides support to stop projection in form and alignment of both club head and weight. Secured in movement by a machine screw at base of club head, which is centrally positioned between the "T" formation and toe, in order to prevent movement of weight by the applied pressure to the inner wall of the club head.

U.S. Pat. No. 5,518,243 to Redman discloses a wood-type golf club head with adjustableweight configuration. The weight distributor includes an array of apertures designed to receive spherical weights positioned in aperture to adjust the center of the mass of the club head in accordance with the particular swing characteristics of a golfer using the golf club. The cavity and the weight distributor are located at the lower back of the club head and substantially behind the ball striking face when attached are oriented in a manner as to give the appearance of a one piece club head and maximize the weight distribution affect relative for the ball striking face. The weight distributor is a one piece unit.

SUMMARY OF THE INVENTION

The general objective of the present invention is to provide a golf club which overcomes the natural tendency of existing golf clubs to rotate during impact by moving the force from the shaft to a point somewhere between the toe and the heel of the club.

The instant invention is a new club designed to help the golfer to strike the ball more accurately and more efficiently and thereby improve the golfer's game. The invention pertains to a golf club, wood or iron, which moves the "SWEET SPOT", the area of the face which is most effective in hitting the golf ball. The movable weight will transmit the force from the shaft to a point somewhere between the toe and the heel of the club and may be used to eliminate slice or hook. For example, if the golfer consistantly slices the ball, the weight is moved closer to the toe to place more weight on the outside to prevent the club from turning and thereby slicing the ball. If the golfer consistently hooks the ball, the weight is moved to the heel to place more weight on the inside to prevent the club from turning and thereby hooking the ball. The face of each club is angled at the appropriate angle for each of the required loft angles. The keel shaped sole of the club head lets it glide through the grass. The movable location of the weight "sweet spot" reduces the effects of opening or closing the face of the club and thus reduces the opportunity for slicing or hooking the ball.

DETAILED DESCRIPTION OF THE PREFERRED EMBODIMENTS

Figure 1:
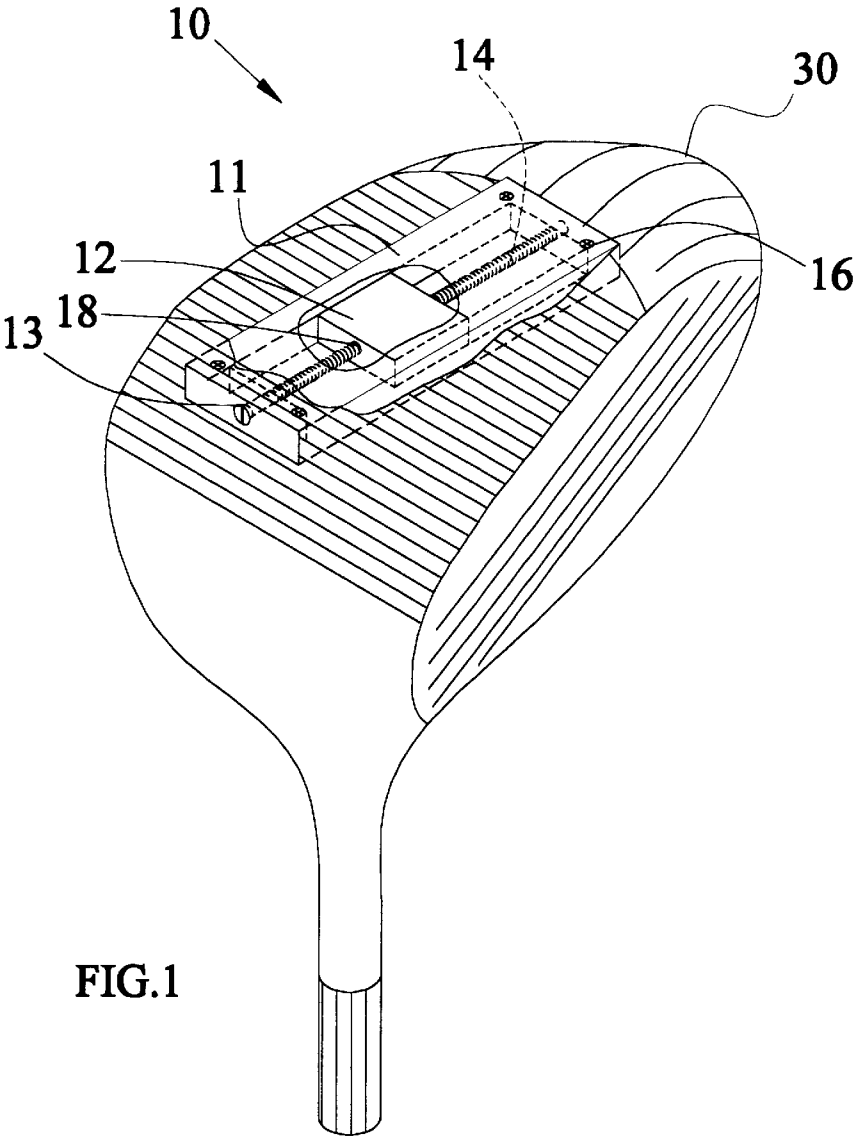
FIG. 1. is a bottom perspective view, partially cut away of the head of the golf club in accordance with the invention.
Figure 2:
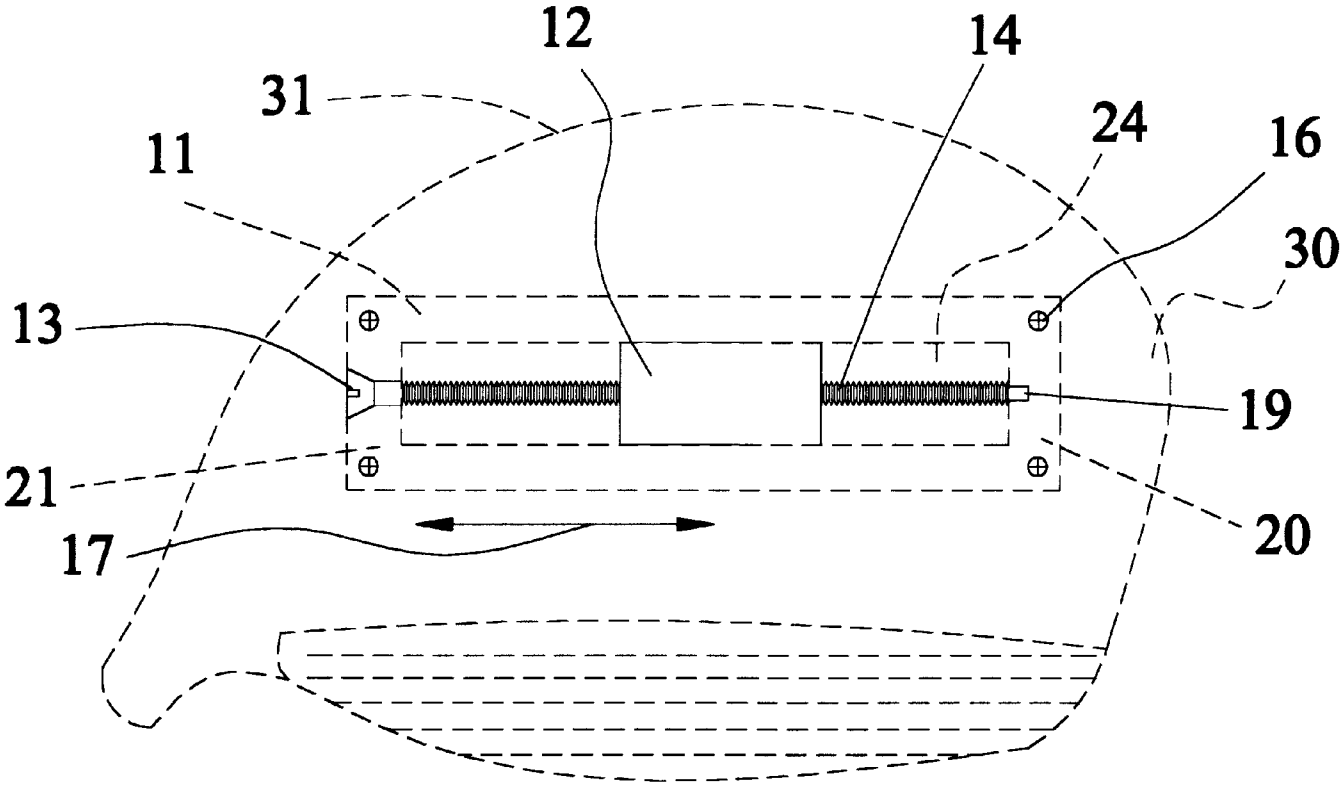
FIG. 2. is a bottom view of the movable weight in accordance with the invention.
Figure 3:
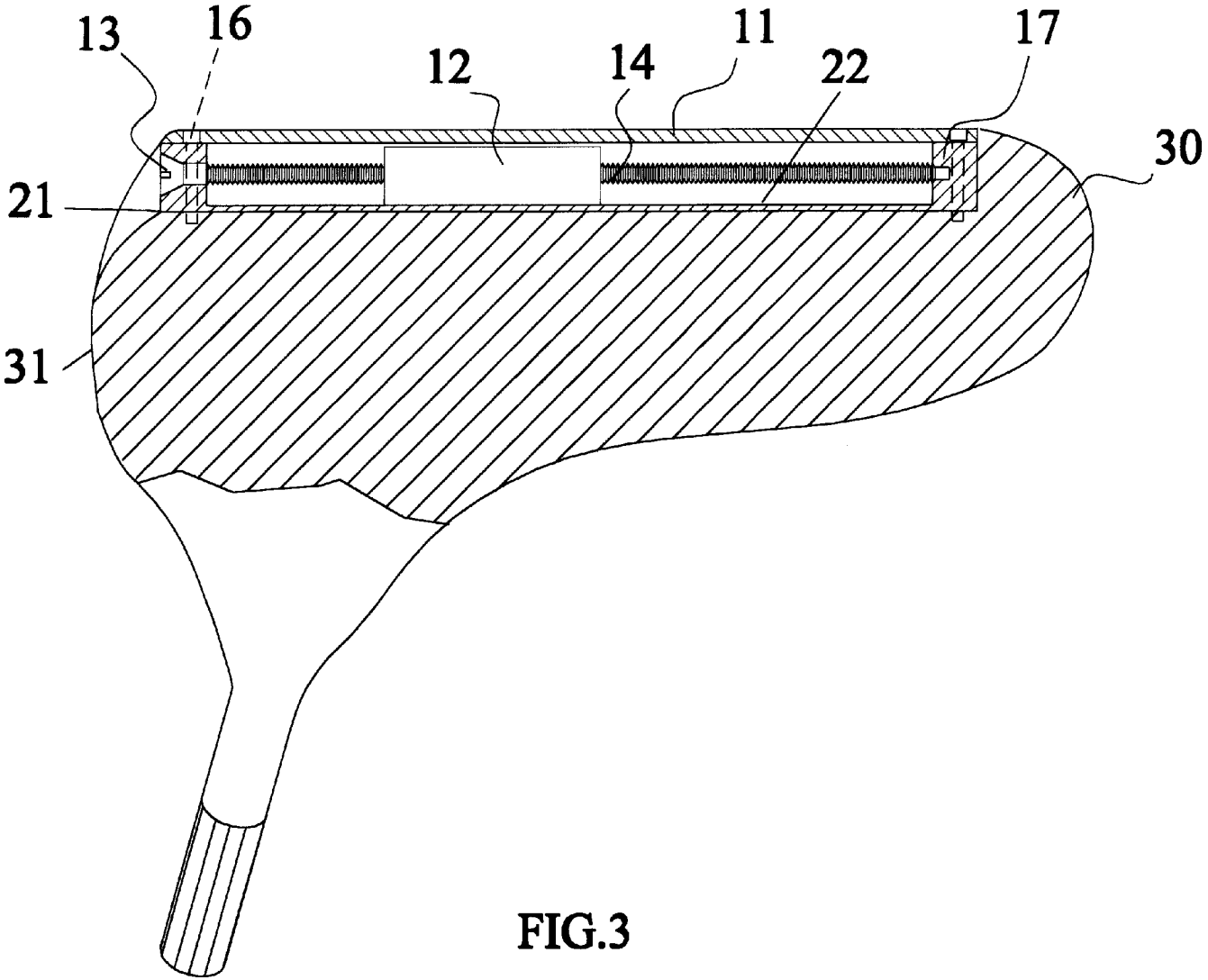
FIG. 3. is a side view of a golf club with the movable weight mounted in accordance with the invention.

Referring now to the drawings wherein like numerals designate like and corresponding parts throughout the several views, a movable weight golf club is shown in FIGS. 1 through 3, and is designated generally by the numeral 10. The movable weight 12 may consist of lead or other heavy weight material formed in a rectangular shape with an adjusting screw 14 threaded through a threaded hole 18. Adjusting screw 14 is held in operating position at each end with the blunt end 19 rotatably mounted in end support 20 and the slotted screw end 13 is rotatably mounted in end support 21. The weight base 22, with cover 11, is mounted in a cavity 24 formed in the bottom of golf club 10 and held in place by screws 16.

Turning the adjusting screw 14 moves the weight 12 between the toe 30 and the heel 31. Slotted head 13 is easily accessible for turning with a coin, such as a dime, to provide a convenient adjustment position. The entire assembly is located within the golf club 10 with only the slotted head 13 being visible. The remainder of the golf club 10 looks like any ordinary golf club. In practice, the golfer sets the movable weight 12 in a starting position and begins to hit golf balls. The movable weight 12 is slid incrementally from heel to toe to change the swing characteristics of the club 10 to fit the user's swing. practice is continued until the "sweet spot" is found.

Thus it will be appreciated that the present invention provides a novel, movable (adjustable) weight golf club with a variable effect on the swing of a golfer. It is contemplated that other embodiments and/or modifications may be made in the present invention without departure from inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A golf club having a shaft, a grip on one end of said shaft and a club head at the other end of said shaft; said club head including a heel, toe, upper surface, bottom sole, ball striking face and back of the club head, wherein the improvement consists of:

a cavity formed in said club head near said bottom sole and extending across said club head between said heel and said toe, a base mounted in said cavity, said base having a first end support located near said toe and a second end support located near said heel, an adjusting screw having a slotted end and a blunt end, said blunt end being rotatably mounted in said end support near said toe end and said slotted end being rotatably mounted in said end support near said heel, a weight having a threaded hole formed therein, said weight mounted on said adjusting screw, said weight being movable on said adjusting screw between said heel and toe and parallel to said striking face, and a cover mounted on said base, over said cavity, said cover and said base being fastened to said club head with screws running through said cover, and through said end supports and connecting to said club head, thereby forming a movable "sweet spot" behind said striking face in a direction from heel to toe.

2. A golf club as recited in claim 1 wherein said movable weight is formed from a heavy weight metal.

* * * * *